United States Patent [19]

Manfreda

[11] 4,062,563

[45] Dec. 13, 1977

[54] SKI BINDING

[76] Inventor: Walter Manfreda, Bahnhofstrasse, Seefeld, Tyrol, Austria

[21] Appl. No.: 758,504

[22] Filed: Jan. 11, 1977

[51] Int. Cl.[2] ..... A63C 9/08

[52] U.S. Cl. ..... 280/625; 280/626; 280/629; 280/631

[58] Field of Search ..... 280/625, 624, 615, 626, 280/628, 631

[56] References Cited

U.S. PATENT DOCUMENTS

| | | | |
|---|---|---|---|
| 3,638,959 | 2/1972 | Renge | 280/625 |
| 3,743,308 | 7/1973 | Allsop | 280/625 |

FOREIGN PATENT DOCUMENTS

| | | | |
|---|---|---|---|
| 1,800,691 | 11/1969 | Germany | 280/625 |

*Primary Examiner*—Robert R. Song
*Attorney, Agent, or Firm*—Brown, Murray, Flick & Peckham

[57] ABSTRACT

On a support for attachment to a ski there is at least one ski-boot clamp that is movable from a boot-clamping to a boot-releasing position. A leaf spring has one end disposed in the clamp while means on the support hold the other end of the spring. The spring normally holds the clamp in clamping position but yields to a force sufficient to cause the spring to bend to permit the clamp to be moved out to boot-releasing position. The spring is curved transversely, with its concave side facing in the direction of the counter force that the spring exerts on the clamp while resisting movement of the clamp toward releasing position.

15 Claims, 13 Drawing Figures

Fig.5
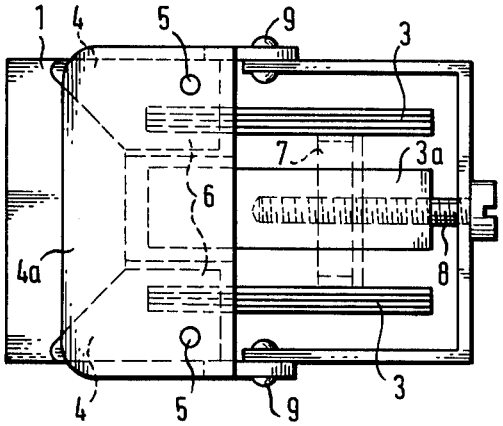
Fig.6
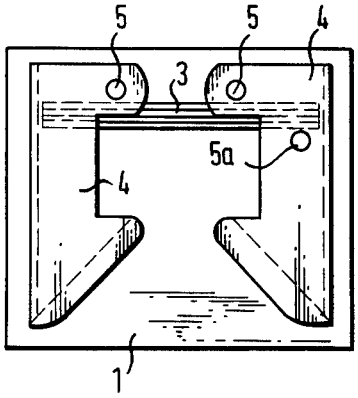
Fig.7
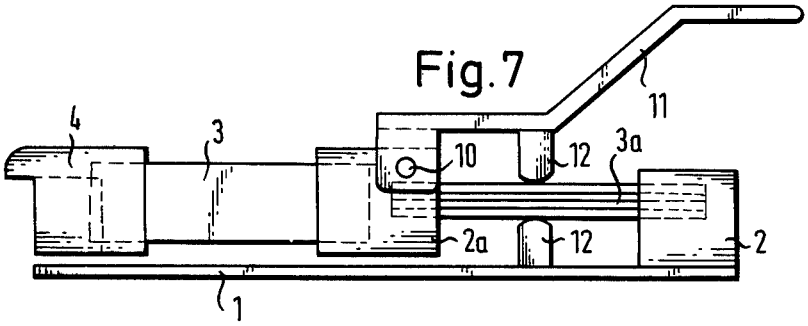
Fig.8
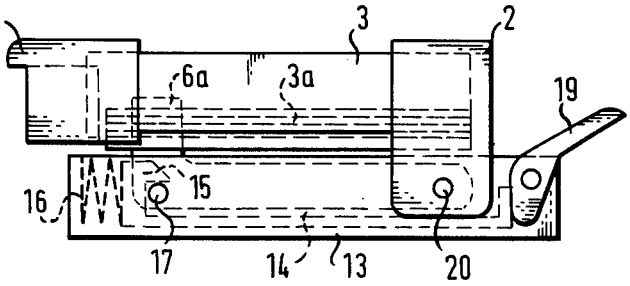
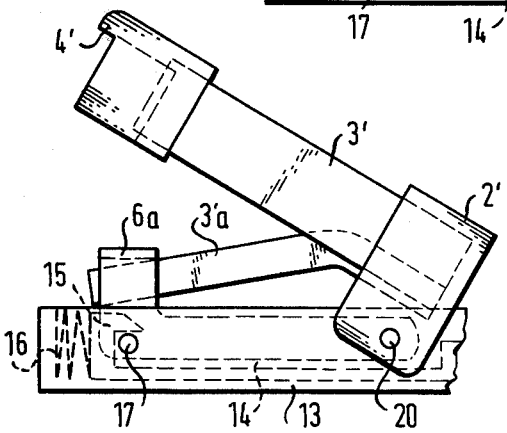
Fig. 9

Fig.10
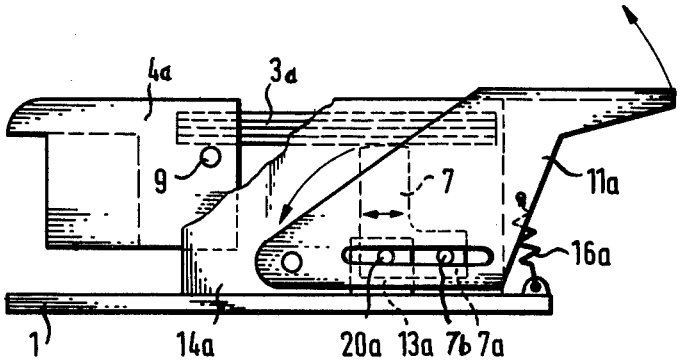
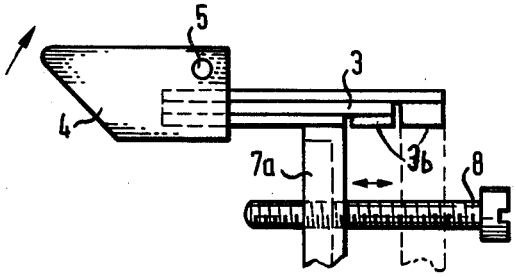
Fig.11
Fig.12
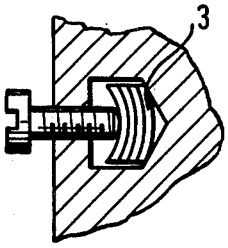
Fig.13
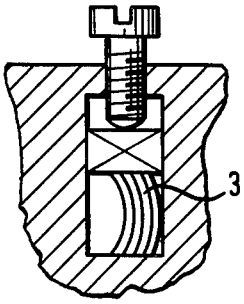

SKI BINDING

Many forms of ski-bindings are known, the object of which is to open during dangerous falls in order to release the foot of the skier. Nevertheless, as revealed by statistics, there are still a great number of skiing injuries, some of them of a quite serious nature, which are due to the fact that the bindings did not open at the critical moment. For yielding during falls, such bindings have made use of, for example, balls disposed in recesses or travelling over inclined planes under the action of a stressed spring. Another system makes use of a spring-actuated piston, which works in association with a cam and serves to drive back the boot tip after short sideways swiveling. In addition, spring-actuated toggle levers and other lever mechanisms, which serve as heel units fitted with movable side-irons attached to a transverse spring, have been put on the market.

All of these ski-bindings, however, have drawbacks in common; namely, they are generally too heavy and, in their functioning, are greatly dependent on friction effects or on greasing or maintenance. In addition, adjustments must be made with exactness to suit each individual person using the bindings, or else accidental releases will be unavoidable.

It is an object of this invention to overcome these drawbacks and create the simplest possible and yet the most reliable ski-binding.

The objectives of the invention are achieved with a ski-binding in which the toe-iron is held in its normal position by means of a leaf spring that is curved transversely, with its convex side facing toward the released direction, and where the force to overcome in order to free the foot is the bending force of the spring.

In a further, more advantageous form of construction, two side clamps, each of which can pivot on a vertical axis, are connected together by means of a common concave leaf spring that can be stressed from one side. However, the spring also can be actuated from at least one end and preferably it is secured in position by means of a pin or the like which passes through it. Furthermore, the spring can be disposed loosely between two adjacent bearings of a clamp or a retaining block, the arrangement being such that one bearing engages the convex side while the other bearing engages the concave side of the spring.

In addition, a counterbearing or thrust block for the spring may be provided that can be moved by means of an adjusting screw or the like to adjust the effective length of the spring. Or, a tensioning device can be provided to change the curvature of the spring. These last two features serve to modify the spring's characteristic curve. However, when, in accordance with a variant of the invention, the concave leaf spring is assembled from two laminations, the lamination closer to the thrust block can be made shorter than the other lamination in order to modify the spring characteristics.

In order to make it easier to step into and out of the binding, a releasing device that embraces the spring can be provided. Or, the clamp support can be mounted on an auxiliary frame in such a manner as to swing relative to the frame on a horizontal axis. This arrangement is such that the support can be releasably locked to the auxiliary frame. Alternatively, the support can be fixed to the base plate and arranged so that it can be made to rotate relative to the base plate on a horizontal axis by means of a lever, which advantageously rotates it in the direction toward the region where the spring bends, or it can be slid longitudinally in that direction, for example, in a groove.

The invention is illustrated in the accompanying drawings, in which:

FIGS. 5 and 6 are plan views of two different modifications;

FIG. 7 is a side view of another variant with a releasing device;

FIG. 8 is a side view of a further variant;

FIG. 9 is a side view showing the binding of FIG. 8 in boot-releasing position;

FIG. 10 is a side view, partly broken away, of a further modification with a releasing device;

FIG. 11 is a fragmentary plan view of a still further modification; and

FIGS. 12 and 13 are fragmentary cross sections illustrating two different ways of adjusting the spring force.

In the forms of constructions illustrated, each leaf spring is shown as consisting of an assembly or lamination of two or more steel strips, which can be coated with a plastic in order to reduce friction and, if necessary, to provide protection against corrosion. However, if desired, the leaf spring can consist of a single steel strip. In either case, the spring is rectangular in shape and is curved transversely, meaning it is curved around an axis extending lengthwise of the spring. This concave spring offers very small resistnace in opposition to any bending around an axis perpendicular to the axis just mentioned in the event that the bending moment is directed toward the concave side of the hollow spring. However, when the bending moment is directed toward the convex side, a considerable amount of force is necessary to deform the spring, which will bend or buckle when the force reaches a specific value. With a ski-binding made in accordance with this invention, this bending force must be exceeded in order to move a toe clamp out of its normal clamping position and into its releasing position. The required bending force can be adjusted by altering the length of the spring and/or modifying its curvature. If the spring is built up from a number of laminations, it can be made in the form of a step spring. Also, the individual laminations can be given different curvatures. Tests have shown that shortening the spring to half its length increases the required bending force by about 30%. The concave spring can be mounted as a floating spring or it can be attached to a toe clamp or the foot plate or to both.

Figure 1:
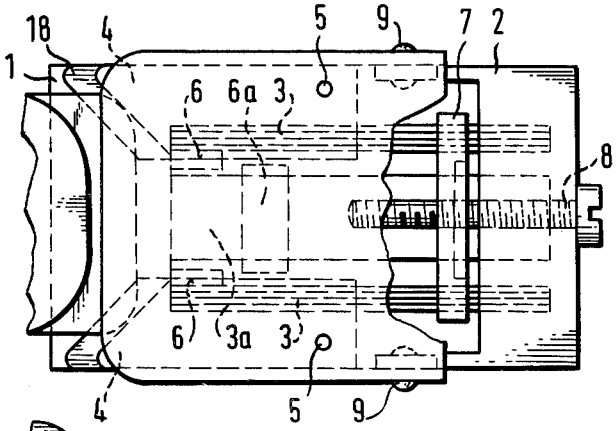
FIG. 1 is a plan view, partly broken away, of one form of the ski binding.
Figure 2:
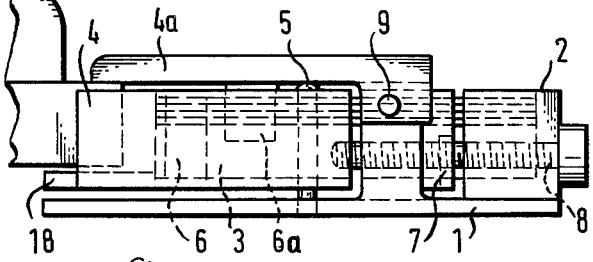
FIG. 2 is a side view.

Referring to FIGS. 1 and 2 of the drawings, a support or foot plate 1 is provided with holes (not shown) for attaching it to the top of a ski by means of screws. At the front end of the plate a block 2 is rigidly mounted on it. This ski binding is provided with three clamps, including two side clamps 4 that can swing around vertical pivot pins 5 rigidly mounted in the foot plate. These two clamps are disposed symmetrically in respect of the central longitudinal axis of the binding and they serve to grip and retain the toe of the ski boot from both sides. The third clamp **4*a*, above the side clamps, can pivot on horizontal pivot pins 9 connecting its front end with rearwardly extending projections of block 2. Laminated leaf springs 3 and 3*a*, such as already described, have their front ends mounted in the block. Their rear ends are slidably mounted in stirrups 6 and 6*a*** projecting from the clamps. If need be, the springs may be provided near the stirrups with slots, through which pass locking pins or screws that are fastened to the stirrups or to the clamps.

The side springs 3 extend through openings in a thrust block 7 that can be made to travel in a longitudinal groove in the foot plate by means of an adjusting screw 8 threaded in the block. This thrust block is shown adjacent to block 2.

It will be seen that clamps 4 and 4*a* are held firmly in their normal clamping position by the three springs, but if the forces exerted against the clamps exceed the value of the required bending force as determined by the position of thrust block 7, the springs will bend and free the ski-boot, in the process of which springs 3 will lie closely adjacent to the thrust block. After releasing a ski-boot, the springs will swing the clamps back to their normal positions.

Figure 3:
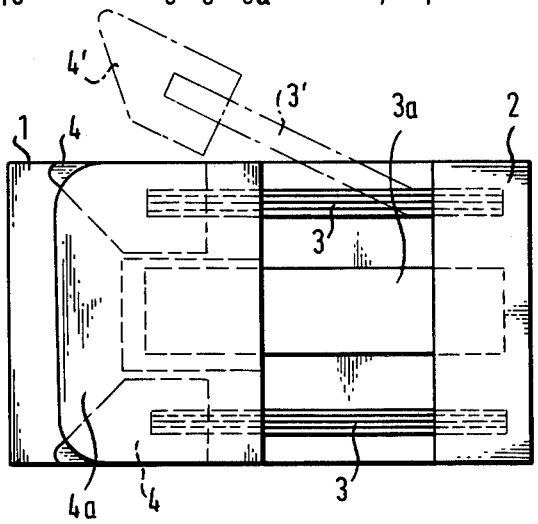
FIG. 3 is a plan view of a modification.
Figure 4:
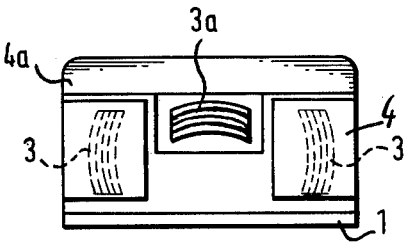
FIG. 4 is an end view of FIG. 3.

A simpler form of ski-binding is illustrated in FIGS. 3 and 4, in which, as in all subsequent figures, similar components are designated with the same reference numbers. In this case the clamps 4 and 4*a* are attached only to the concave leaf springs 3 and 3*a*, respectively, by rigid connections. They are not pivotally mounted on the foot plate 1. It may be found satisfactory to assign a parallel spring to each concave spring to prevent any tendency of the springs to twist. The front ends of the springs are rigidly mounted in block 2 on foot plate 1. One of the clamps is shown in dotted lines in a swung-out or boot-releasing position 4'. The restoring force for a buckled spring is less than about 10% of the force required to deform it.

It has been found that, in the case of concave leaf springs assembled from laminations, doubling the laminations will cause the bending force to be approximately tripled. As a result, different values of the bending force can be selected without the need to employ an adjustable thrust block (as, for example, in children's ski bindings).

In FIG. 5 the clamps 4 and 4*a* are pivotally mounted as in FIG. 1, but the rear ends of the springs 3 and 3*a* are rigidly mounted in the clamps and the front ends of the springs are free. However, the inner faces or concave sides of the springs engage adjustable thrust block 7, which they are press tightly against when the clamps are swung out to releasing position.

The two side clamps shown in FIG. 6 likewise are pivotally connected to the foot plate 1 by means of vertical pivot pins 5. Extending transversely of the foot plate is a transversely curved leaf spring 3 that is common to both clamps. The convex side of the spring presses against pins 5, which preferably are shaped to match the spring curvature. The opposite side of the spring engages pins 5*a* or the like rigidly mounted in the clamps. Side flanges of the clamps prevent longitudinal displacement of the spring. If desired, pins 5*a* could serve as the pivot pins andpins 5 could be attached only to the clamps.

In the further modification shown in FIG. 7, spring 3*a* is disposed in front of springs 3. Springs 3 connect side clamps 4 to a block 2*a* that is attached to the rear end of spring 3*a*. The front end of this spring is mounted in block 2 supported by the foot plate 1. Hinged to block 2*a* on a horizontal axis 10 is the rear end of a lever 11 that carries a downwardly extending lug 12. A similar lug 12 is mounted on the foot plate below the upper lug. These two lugs engage spring 3*a* that is between them. If the front end of the lever is pressed downwardly, the lugs will tend to flatten the transversely curved spring 3*a* to greatly reduce its holding force. As a result, block 2*a*, together with clamps 4, swings upwardly immediately in order to allow the ski boot to be inserted or removed from the binding. Because lever 11 tilts around upper lug 12 it is unnecessary to exert any force on the ski boot. It is evident, of course, that releasing devices of this or a similar type can be associated with the other springs in order to ease the introduction of a ski boot into the binding or its removal. Alternatively, the releasing device can consist, for simplicity, of a lever that is provided with an opening that is matched to the cross section of the spring and through which the spring passes.

FIGS.8 and 9 illustrate a further form of the invention in which a support plate is mounted on an auxiliary frame 13, relative to which it can pivot on a horizontal axis 20. At its opposite end the frame is provided with a pin 17, which operates in conjunction with a latch 14 that is displaceable in the frame and is actuated by pressure from a spring 16. The top of the latch is provided with a beveled nose 15, which holds pin 17 in its normal lower position. The latch can be moved away from the pin against the force of spring 16 by means of a lever 19, as a result of which pin 17 is free and the binding can be lifted. The support also is provided with a block 2, in which the front ends of curved springs 3 and 3*a* mounted. The rear ends of springs 3 are rigidly connected to clamps 4. The corresponding end of spring 3*a* is slidably mounted in a stirrup 6*a* which is also tiltable around pin 20. The releasing position of the clamps is shown at 4' in FIG. 9. If desired, suitable thrust blocks can be provided to adjust the release forces of the springs.

Yet another form of construction of a releasing device is illustrated in FIG. 10, in which a support member 13*a* that can be displaced relative to foot place 1 via a groove and associated adjusting screw (not shown) is provided with a projecting horizontal pin 20*a* on which a thust block 7 is rotatable. The upper end of the block normally engages the bottom of curved spring 3*a*. The lower part of the thrust block is provided with forwardly projecting portions 7*a* that carry pins 7*b* or the like. All of these pins extend into horizontal slots in the opposite sides of a lever 11*a* pivotally mounted on binding housing 14*a*. By raising the front end of the lever against the action of a spring 16*a*, thrust block 7 will be rotated about 90° in the direction of the clamp 4*a*. This will disengage the block from the spring, as a result of which the clamp, which is mounted on pin 9 pivotally mounted in binding housing 14*a*, can be lifted without any resistance from the spring. On closing the binding, spring 16*a* pulls lever 11*a* back to its normal position and thereby swings thrust block 7 back to its upright position. The functioning of any side clamps that may be present is,not impared by the tilting of block 7. On the other hand, longitudinal displacement of block 7 as close as possible to pin 9 would likewise serve for raising clamp 4*a*.

Mention has already been made of possible ways of adjusting the sprint-bending force. It it is to be modified by changing the curvature or the camber of a spring, there is provided for this purpose a stressing device which, for simplicity, is provided with a self-locking thread and which either engages the concave side of the spring, the edges of which are braced, or presses on the narrow sides of the spring. These ideas are shown in FIGS. 12 and 13, respectively.

FIG. 11 shows as one of the possibilities for adjusting the buckling force an arrangement of a stepped spring 3, in which the laminations lying to the inside of the curved spring are shorter than the other laminations. By displacing a thrust block *7a* lengthwise of the spring by means of an adjusting screw 8, it is possible to bring more or fewer laminations into action and thus change the releasing force required to release pivoted clamp 4. In order to ensure that the holding force of the spring is maintained, the outer laminations are provided with suitable filler members *3b*.

The invention disclosed herein creates a ski binding which is simple in construction and functionally reliable. It can be easily matched to the forces required for releasing or freeing it and it is free from the influence of frictional forces. In addition, the binding will release under all conceivable circumstances and possible force conditions, so that release is ensured for all the types of fall a skier is likely to encounter. The binding is equally suitable as a heel holder and as a toe holder. Because it has been proved that resting the ski boot on the ski makes release more difficult in rotational falls, clamps 4 may be appropriately equipped with bearing surfaces 18 for the ski boot as shown in FIG. 1.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A ski binding comprising a support for attachment to a ski, at least one ski-boot clamp on said support movable from a boot-clamping to a boot-releasing position, a leaf spring having one end disposed in the clamp, and means on said support holding the other end of the spring, said spring normally holding the clamp in said clamping position but yielding to a force sufficient to cause the spring to bend to permit the clamp to be moved out to said boot-releasing position, and said spring being curved transversely with its concave side facing in the direction of the counter force that the spring exerts on the clamp resisting movement of the clamp toward said releasing position.

2. A ski binding according to claim 1, in which said spring is laminated from a plurality of metal strips.

3. A ski binding according to claim 1, including adjustable means for changing the curvature of said spring.

4. A ski binding according to claim 1, including means pivotally connecting said clamp with said support.

5. A ski binding according to claim 4, one end of said spring being rigidly connected to said clamp.

6. A ski binding according to claim 4, said holding means being a block rigidly mounted on said support, one end of said spring being rigidly connected to said clamp and the opposite end being rigidly connected to said block.

7. A ski binding according to claim 1, one end of said spring being rigidly connected to said clamp, and said holding means including a spring-engaging member adjustable lengthwise of the spring and engaging one side of it.

8. A ski binding according to claim 7, in which said spring is laminated from a plurality of metal strips, and the ends of the strips beside said spring-engaging member are of different lengths.

9. A ski binding according to claim 1, in which said holding means is a block rigidly mounted on said support, one end of said spring is rigidly connected with said block and the opposite end of the spring is rigidly connected with the clamp, the spring forming the sole support for the clamp.

10. A ski binding according to claim 1, including three of said clamps and leaf springs, two of the clamps being laterally spaced and the third clamp being disposed above said two clamps and movable upwardly to boot-releasing position.

11. A ski binding according to claim 1, including two laterally space ski-boot clamps, parallel pivot pins pivotably connecting said clamps to said support, said spring extending transversely of the support with the opposite ends of the spring connected with said clamps.

12. A ski binding according to claim 11, in which said spring extends substantially parallel to the common plane of said pivot pins and with one side in engagement with them, said binding including means on the clamps engaging the opposite side of the spring.

13. A ski binding according to claim 1, in which said clamp is movable up and down relative to said support, and said binding includes manually operable means engaging said spring for moving the clamp away from the support.

14. A ski binding according to claim 1, in which said clamp is movable up and down relative to said support, and said binding includes an auxiliary frame pivotally supporting said support on a horizontal axis, and manually operable means for releasably latching the support to said frame.

15. A ski binding according to claim 1, in which said clamp is movable up and down relative to said support, said holding means includes a block beneath the spring in engagement therewith and adjustable lengthwise of it, and said ski binding also includes means for tilting said block toward the clamp to space it from the spring.

* * * * *